United States Patent [19]

Tertishnikov et al.

[11] 4,273,180

[45] Jun. 16, 1981

[54] PROCESS AND APPARATUS FOR CONTINUOUS CASTING OF METAL IN ELECTROMAGNETIC FIELD

[76] Inventors: Anatoly S. Tertishnikov, ulitsa Sovetskaya, 42, kv. 9; Boris P. Platunov, ulitsa Sovetskaya, 40, kv.51, both of, Mtsensk Orlovskoi oblasti; Alexei V. Novikov, ulitsa Vvedenskogo, 24, kv. 12, Moscow; Nikolai A. Gordeev, ulitsa Karla Marxa 81, kv. 29, Mtsensk Orlovskoi oblasti; Eduard K. Belebashev, ulitsa Narodnaya, 7, kv. 40; Dmitry P. Lovtsov, ulitsa Butlerova, 10, kv. 132, both of, Moscow; Vladimir A. Korytov, 1 Mikroraion, 6, kv. 67; Jury P. Ignatiev, 1 Mikroraion, 18, kv. 34, both of, Mtsensk Orlovskoi oblasti, all of U.S.S.R.

[21] Appl. No.: 18,835

[22] Filed: Mar. 8, 1979

[51] Int. Cl.[3] ..... B22D 27/02

[52] U.S. Cl. ..... 164/49; 164/147; 164/66

[58] Field of Search ..... 164/49, 147, 250, 82, 164/89, 66

[56] References Cited

U.S. PATENT DOCUMENTS

| | | | |
|---|---|---|---|
| 3,066,364 | 12/1962 | Baier | 164/82 |
| 3,612,151 | 10/1971 | Harrington | 164/89 |
| 4,004,631 | 1/1977 | Goodrich et al. | 164/250 |
| 4,071,072 | 1/1978 | McCubbin | 164/89 |

FOREIGN PATENT DOCUMENTS

| | | | |
|---|---|---|---|
| 455794 | 2/1975 | U.S.S.R. | 164/49 |

*Primary Examiner*—Robert D. Baldwin
*Assistant Examiner*—K. Y. Lin
*Attorney, Agent, or Firm*—Steinberg & Raskin

[57] ABSTRACT

A continuous casting process effected in electromagnetic field includes the steps of delivering a molten metal to the zone of an electromagnetic field, forming said molten metal into a column, providing a protective medium such as a melt or rarified atmosphere at the molten surface of the solidifying ingot, sizing the ingot skin, and cooling the solidified ingot.

An apparatus for carrying into effect the above-described continuous casting process comprises a frame which mounts a baffle, an electromagnetic inductor and a cooler, all of which are circular in shape and coaxially arranged relative to one another. The apparatus also incorporates a bottom plate adapted to support the ingot. According to the invention, there is also provided at least one shell intended for holding the slag or flux melt at the liquid surface of the continuous-cast ingot, as well as for creating a rarified atmosphere and for sizing the ingot, thereby permitting the latter to be formed of a desired shape and size.

16 Claims, 24 Drawing Figures

PROCESS AND APPARATUS FOR CONTINUOUS CASTING OF METAL IN ELECTROMAGNETIC FIELD

BACKGROUND OF THE INVENTION

1. Field of the Invention

The present invention relates to metallurgy and more particularly to a process and apparatus for the continuous casting of metal in an electromagnetic field. The invention permits a wide choice of metals to be used for casting ingots by the proposed method.

This invention may find most utility in the production of ingots by continuous and semi-continuous casting processes wherein a magnetic field is used for forming the ingot liquid portion in an electromagnetic field in the event of casting ingots from refractory and easily oxidizable metals and alloys which do not form sufficiently protective oxide films on the melt surfaces thereof as well as from alloys composed of high vapour-pressure alloying components. In addition, the invention is readily applicable in the production of ingots, effected by means of remelting consumable electrodes.

2. Description of the Prior Art

For example, U.S.S.R. Inventor's Certificates No. 338,037 and No. 282,615 describe processes and apparatus for continuous casting of metals in the electromagnetic field of a magnetic inductor functioning as contactless means for forming the ingot liquid portion, with the side surface of the ingot being subjected to direct and intensive cooling.

The practice of casting ingots in electromagnetic field from aluminum and some of its alloys has been found superior to conventional continuous casting process performed on a continuous casting machine provided with a slidable force-cooled mold. The ingots are produced to have high-quality side surfaces and a uniform chemical composition across its section, as well as uniform crystalline structure, the features substantially improving the ingot workability and mechanical properties of alloys.

It should be observed, however, that the prior-art apparatus and processes of casting metal in electromagnetic field permit the production of quality ingots which are cast from the metals and alloys which form on their surfaces a uniform and dense protective oxide film similar to that formed in the process of casting ingots from aluminum, which film makes it possible for the ingot liquid portion to be supported in the form of a column, with the static pressure of the ingot metal being slightly increased or the process conditions, such as the speed of lowering the bottom plate with an ingot, shocks, the bottom plate vibration, the rate of solidification, being slightly varied in the course of the ingot casting and solidification process.

There are known several types of high-temperature metals, as well as high-alloyed metals containing highly volatile components. Where such metals are subject to casting in electromagnetic field, violent turbulence takes place in the ingot liquid zone, caused by high convective flows of melt in the ingot liquid zone and by vertical uplift of the bubbles due to the sublimation of the alloying components. If not damped, such violent turbulence on the surface of the ingot liquid portion, as well as the discharge of slag and oxide inclusions, causing nonuniform interaction with magnetic field, impair the process of formation and solidification of the side surface of the ingot liquid portion, thereby making it impossible to produce high-quality ingots. Furthermore, because of the violent turbulence in the ingot liquid zone, and in its top portion in particular, accurate control over the level of the ingot liquid surface is rendered difficult to carry out in the event of casting ingots from the above-mentioned alloys. It is known that a change in the level of the ingot liquid zone brings about a proportional change in the ingot cross-sectional dimensions. With an excessive height of the ingot liquid zone, the casting process is disrupted. The aforementioned features, specific to the prior-art continuous casting processes and apparatus, are aggravated and become harmful in the casting of heavy nonferrous and ferrous metals and alloys thereof, which form no protective oxide film on the melt surface, making it possible for the column of the ingot liquid zone to be supported under the action of an electromagnetic field, which is otherwise spread over a more than 20 percent increase in the height of the ingot liquid zone.

It is therefore necessary to minimize detrimental effect of the ingot liquid zone turbulence on the ingot formation and solidification process, and to prevent oxide film and foam from setting onto the ingot side surface.

The aforementioned disadvantages of the prior-art casting apparatus and processes are mostly due to high sensitivity of the ingot forming process to slight variations in the process conditions. Thus, a high sensitivity of the contactless process of the ingot formation effected under the action of electromagnetic field is regarded as one of the basic difficulties encountered in the course of practical implementation of the known casting process which turns out to be impractical where high-quality ingots from refractory and easily oxidizable metals and alloys, not forming sufficiently protective oxide film on the melt surface, are required.

The above-mentioned disadvantage of the prior-art casting process is due to the difficulty of ensuring constant control of the resultant magnetic field forming the ingot liquid portion, and of the metal static pressure acting vertically on the ingot liquid portion, as well as due to the absence of low-inertion automatic correction of the ingot forming process when introducing variations into the process conditions in the course of casting high-temperature metals and alloys.

It has been found that a mere increase in the height of the ingot liquid portion, for example, by at least 3 to 5 mm, brings about respective increase in the cross-sectional dimensions of the ingot liquid portion. The casting process is disrupted as the balance of forces between the metal static pressure and that of magnetic field is violated to exceed the permissible level. Variations in the height of the ingot liquid portions or in the electric parameters of the magnetic pumping means, as well as variations in the ingot withdrawing speed, adversely affect the quality of ingots cast from heavy high-temperature and easily oxidizable metals and alloys, such as aluminum-base alloys, which do not form sufficiently protective oxide films on their melt surfaces, ensuring stable ingot-forming process.

Metals such as aluminum and some of its alloys do not require good heat protection or protection from oxidation of the ingot liquid portion, since the oxide film formed on the ingot liquid portion serves as a reliable protection from oxidation and, consequently, prevents the formation of slags and froth-like oxides on the surface of the metal, even if slightly overheated prior to casting operation.

The metals and alloys, having relatively high melting and solidification temperatures and being easily oxidizable, do not tend to form such oxide film on their melt surfaces as aluminum and some of its alloys. Moreover, such types of metals tend to form on their surfaces a thin skin of metal solidifying on the meniscus of the ingot liquid zone, which is broken by convective flows of the melt and is then entrained together with the slag and oxide solid inclusions to be transferred to the side surface of the ingot liquid portion, thereby impairing the ingot forming and solidifying process.

Attempts have been undertaken to use inert gases as protective atmosphere above the surface of the liquid portion of an ingot formed in magnetic field. For example, the U.S.S.R. Inventor's Certificate No. 455,794 describes an apparatus for casting metal in magnetic field. The apparatus is provided with a cover which closes the ingot-forming cavity and has a pipe for a protective gas to be applied therethrough. To prevent the atmosphere air from penetrating into the ingot-forming cavity, a funnel-shaped element is fixed below the water supply level and is filled with the water flowing off the surface of the water-cooled ingot and forming a steam blanket between the supplied inert gas and ambient atmosphere.

The apparatus described above allows only inert gases to be used as the protective atmosphere.

However, it is likewise impossible to ensure the production of ingots with high-quality side surface from alloys the components of which have relatively low boiling point and, therefore, with which it is preferable to have their liquid surfaces protected with flux melts. The use of flux melts with this type of apparatus is impossible because of the fact that such melts will flow off the ingot horizontal liquid surface onto the side surface thereof to interact with the cooling water. Since the apparatus cannot be hermetically sealed, it does not allow the use of vacuum.

From the above it follows that the prior-art apparatuses and processes for continuous casting of metal in electromagnetic field do not permit, on account of characteristic features inherent in the procedure of contactless formation of the ingot liquid portion in magnetic field and intensive direct cooling of the ingot side surface, the production of high-quality ingots from high-temperature and easily oxidizable metals and alloys which do not permit sufficiently protective dense oxide film to be formed on the ingot liquid surface as, for example, aluminum-base alloys, as well as from alloys having high vapour-pressure components included therein.

The prior-art casting processes in question fail to provide necessary protection to the upper portion of the ingot liquid zone from undesired losses of heat; the side surface of the ingot liquid portion being left unprotected from penetration of slag or oxide films with solid metal inclusions from the upper portion of the ingot liquid zone. This results in the impairment of appropriate conditions required for uniform formation of the ingot liquid portion and disturbs uniformity in the ingot solidification at the side surface thereof.

Furthermore, it is impossible to protect the entire surface of the ingot liquid portion with a layer of protective-degassing flux or to provide protective rarified atmosphere thereabove.

Where ingots are cast from an alloy with high vapour-pressure components, for example, zinc in brass, the escape of vapours through the open surface of the ingot liquid portion impairs the ingot forming process accompanied by violent turbulence of metal in the ingot liquid portion and results in the appearance of flaws on the ingot side surface and its peripheral layer.

The known casting processes of the type described above fail to provide for the production of presized ingots, or ingots with the cross-sectional profile thereof being different from the cross-sectional profile of the ingot liquid portion.

Such processes are unsuitable for the production of ingots having on their side surfaces a layer of metal with chemical composition thereof being different from that of the ingot metal, for example, a layer of solidified flux protecting the ingot surface from oxidation, or a layer of clad metal, or else a thin layer of alloy, for example, copper tin, copper-lead on copper ingot.

The disadvantages inherent in the prior-art casting processes and apparatuses make it impossible to combine a highly efficient process of casting high-quality ingots in magnetic field with a casting process effected by means of melting consumable electrodes.

However, the problems posed by general and metallurgical engineering demand urgent solutions required to further improve the known processes and apparatuses for casting metal in magnetic field. The expected solutions to these problems have enormous practical significance for the production of ingots from refractory easily oxidizable metals and alloys thereof, such as iron, nickel, titanium, copper, silicon, germanium, as well as from the alloys containing high vapour-pressure components, such as, for example, zinc and aluminum, i.e. from the metals and alloys which, unlike aluminum, do not permit a sufficiently dense protective oxide film to be formed on the surface of the liquid portion of the ingot solidifying under the action of an electromagnetic field.

SUMMARY OF THE INVENTION

It is the primary object of the invention to provide a process for continuous casting of metal in electromagnetic field, which will enable the production of high-quality ingots from the metals which require protective medium from gases, slag or flux melts; also permitting the use of rarified atmosphere or vacuum.

Another important object of the invention is to provide an apparatus for continuous casting of metal in electromagnetic field, which will permit a melt to be used as the protective medium.

Another object of the invention is to improve the quality of the side surface of an ingot to be produced in strict conformity with specified cross-sectional dimensions and configuration.

Still another object of the invention is to improve the quality of the ingot metal.

These objects and features of the invention are accomplished by the provision of a process and apparatus for continuous casting of metal in electromagnetic field. The process of the invention includes the steps of delivering a molten metal onto a bottom plate disposed in an electromagnetic field acting to support the molten metal in the form of a column, providing a protective medium at least at the horizontal liquid surface of the ingot metal, and supplying a coolant to the side surface of the solidified ingot.

The provision of a protective medium above the ingot liquid portion permits the continuous casting process to be carried out in an electromagnetic field wherein use can be made of such metals and alloys which do not allow sufficiently protective dense oxide film to be formed on the surface of the ingot liquid portion, and more particularly from the metals and alloys which, when in molten state, require protection from oxidation and heat dissipation due to physico-chemical characteristic properties thereof.

It is preferable to use the melt of conducting slag and/or degassing flux as the protective medium.

The provision of a layer of molten conducting slag on the surface of the liquid portion of an ingot cast in an electromagnetic field permits the production of high-quality ingots from high-temperature metals and alloys which, by virtue of their nature, require good heat protection to be afforded to the liquid upper portion of the ingot. This is necessary for eliminating the conditions which permit the solidified portions of the metal to be formed on the liquid upper portion of the ingot, tending to slide off onto the liquid side surface of the ingot, thereby impairing the process of the metal solidification and its formation into the ingot with high-quality metal and smooth side surface.

The use of degassing flux as the protective medium permits the production of high-quality ingots from metals and alloys which require additional treatment before being fed to the forming and solifidying zone, whereby physical and mechanical properties of the metal are substantially improved. With the process of the invention it becomes possible to improve both the quality of the ingot metal and the quality of the ingot surface. In addition, favourable conditions are created for combining the process of electroslag melting of consumable electrode with the process of casting metal in electromagnetic field.

The melt used as protective medium is preferably held in place at the side surface of the ingot liquid portion by means of a funnel-shaped band formed with an annular section firmly attached to the skin of the solidifying ingot above the level from which a coolant is supplied to the ingot side surface.

This will permit protection to be afforded not only to the upper horizontal portion of the ingot molten surface, but to the side surface of the ingot liquid portion as well. In this case, slag or degassing flux can be used as the protective melt.

A layer of molten metal with chemical composition thereof being different from that of the ingot metal is preferably provided around the side surface of the ingot molten metal.

The provision of a layer of molten metal disposed around the side surface of the ingot liquid portion and having chemical composition different from that of the ingot metal enables the production of an ingot with a thin peripheral layer from a desired metal. In other words, it becomes feasible to produce a composite ingot or to effect surface alloying of the ingot base metal.

The ingot-forming metal is preferably delivered in an amount sufficient for building up constant metal static pressure with a value thereof being 5 to 20 percent in excess of the rated value of the electromagnetic field compression pressure, as the skin of solidifying ingot is concurrently sized by means of the annular section of the funnel-shaped band with the cross-sectional size and shape thereof being selected in conformity with a specified cross-sectional size and shape of the ingot being cast.

With the afore-indicated excess of the metal static pressure over the compression pressure of electromagnetic field, and with the ingot skin being concurrently subjected to sizing, it becomes possible to produce the ingot in strict conformity with a desired shape and size thereof. If acted upon radially in the direction of the longitudinal axis, the ingot skin is deformed; and provided the ingot liquid portion is of circular or oval shape, a solid ingot is produced to be polygonal in cross section, for example, pentagonal, hexagonal or octagonal, with clearly defined sides and edges. Thus, with relatively simple construction of the electromagnetic mold it becomes possible to produce ingots of complex cross-sectional profile, which is of great practical significance.

There is also provided an apparatus for carrying into effect the process according to the invention for continuous casting of metal in electromagnetic field, which apparatus comprises, mounted on a frame in coaxial arrangement with one another, a baffle, an electromagnetic inductor and a cooler, all of which are annular in shape and set around the ingot forming space defined from the bottom by a bottom plate and from the top by a cover formed with an inlet opening for the passage of molten metal, with an opening for the rod of a metal level gauge to extend therethrough, and with an opening for the protective medium to pass therethrough, wherein, according to the invention, there is provided at least one shell positioned beneath the cover and fixed on the baffle by means of its flange in a manner to allow the lower end face of the shell to be immersed in the molten metal of the ingot, the shell being formed with of a refractory nonmagnetic material chemically inert to a melt of flux or metal and having low heat conductivity.

Such apparatus construction permits a protective medium to be provided above the surface of the ingot molten metal, necessary for several types of metals and alloys unsuitable for the production of ingots by prior-art apparatus of similar type. It is possible to use an inert gas, the melt of conducting slag or degassing flux as the protective medium. The apparatus of the invention allows for melting consumable electrodes when forming ingots in electromagnetic field. In addition, with the shell being immersed in the surface layer of the ingot liquid portion, the melt of slag or flux is retained within the shell cavity on the upper horizontal liquid portion of the ingot.

The material selected for the shell must be sufficiently resistant to the action of high temperatures, chemical substances and electromagnetic forces.

The provision of the shell immersed in the liquid portion of the ingot makes it possible to stabilize the ingot forming and solidifying process while casting ingots in electromagnetic field from metals and alloys which do not form on their surface sufficiently protective oxide film (such, for example, as aluminum and some of its alloys), as well as to prevent the oxides and slags found on the upper portion of the ingot liquid zone from getting to the solidified zone thereof.

The provision of the cover makes it difficult for the molten metal to solidify on the meniscus of the ingot liquid portion. The provision of the shell and cover allows for the space to be provided above the ingot liquid portion and required for a protective medium to be disposed therein, also making it possible to reduce the losses of heat and of the metal volatile components.

It is preferable to provide a second shell spaced externally of and coaxially with the first shell and fixed on the baffle, with the interior dimensions thereof being made such as to enable its contact with the upper portion of the ingot side surface.

Such external shell permits the protective layer of melt to be retained over the entire horizontal molten surface of the ingot. Furthermore, a part of the ingot side surface is protected by the external shell from oxidation; the sublimation of the volatile alloy components with high vapour pressure also being reduced.

The external shell is preferably formed of a material having its physical density 4 to 6 times lower than that of the ingot liquid portion, and, formed internally of the shell, is a horizontal section having fixed thereto a rod of a metal level gauge; the shell per se being freely interposed between the internal shell and the baffle, and having its interior dimensions made such as to enable its contact with the upper portion of the ingot side surface, as well as the contact of its horizontal portion with peripheral section of the horizontal molten surface of the solidifying ingot.

Such shell is floatable on the upper molten surface of the ingot, whereby the detrimental effect of the melt turbulence on the ingot forming process is substantially decreased; the control over the varying level of the ingot liquid portion is greatly inproved, with the level of metal being maintained within a prescribed range, in particular, in those instances when ingots are cast from metals and alloys the components of which have relatively low boiling points.

The external shell is preferably fixed on the baffle by means of its flnge and has its interior dimensions formed such as to provide at the upper portion thereof a gap between its interior surface and the liquid portion of the ingot side surface, the lower portion of the shell being disposed to the ingot-forming zone and formed with a ring-shaped sizing band having its opening area sized and shaped in conformity with a specified size and shape of the finished ingot.

The provision of the external shell, the upper portion of which remains clear of the ingot liquid portion and the lower portion thereof envelopes the solidifying side surface of the ingot skin to thereby effect its sizing, permits the casting process to be effected so as to provide complete and reliable protection to the entire molten portion of the ingot surface with an inert gas, degassing flux and/or conducting slag, as well as with a rarefied atmosphere. This, in turn, makes it possible to conduct the continuous casting process in electromagnetic field by utilizing such metals and alloys thereof that at all times require protection from heat losses and from oxidation as, for example, copper, magnesium, iron, nickel, zinc, silicon, titanium, etc.

The external shell is preferably formed such that its interior dimensions constitute 0.85 to 1.15 times the respective dimensions of the sizing band, the height of which is $\frac{1}{2}$ to $\frac{2}{3}$ of the height of the magnetic inductor, the lower end face of the shell being positioned below the transverse axis of the magnetic inductor within a distance of $\frac{1}{4}$ to $\frac{2}{3}$ of the height of the magnetic inductor.

The interior dimensions of the shell have been selected with due regard to the nature and extent of shrinkage of the ingot metal during its cooling. Where ingots are produced from metals and alloys tending to grow in volume during their solidification, the interior cross-sectional dimensions of the opening area of the shell upper portion will respectively be smaller than the dimensions of the sizing section.

With the height of the sizing section being $\frac{1}{2}$ to $\frac{2}{3}$ of the inductor height, as well as with the end face of the shell being disposed below the level from which the ingot-forming zone starts, the sizing is effected until the ingot side surfaces are partially relieved from strain, and the static pressure of the metal (within a permissible range) is lowered.

The provision of the sizing section at the lower portion of the shell, acting radially on the ingot hot plastic skin in the direction of its longitudinal axis, permits the production of ingots sized in cross-section throughout their lengths, as well as of ingots having their cross-sectional profiles different from that of the ingot liquid portion. In other words, with a relative shape and construction of the magnetic conductor, a contactless ingot forming process is enabled to permit the production of circular,—and oval-shaped ingots, pentagonal, hexagonal and octagonal in cross-section and having clearly defined sides and edges thereof.

Advantageously, the side walls of the interior shell are formed with perforations and are interconnected by means of a transverse perforated partition.

The provision of perforations in the side walls of the interior shell permit a uniform layer of protective medium to be disposed above the molten surface of the solidifying ingot, and the pressure of the metal jet passed through a header into the ingot-forming zone to be reduced. An original powerful jet of metal is divided into several metal jets uniformly distributed across the ingot liquid zone, thereby permitting convective displacements of the melt to be substantially reduced and the quality of the ingot metal to be improved.

The wall of the external shell is preferably formed with gating channels intended for the supply of metal having its chemical composition different from that of the ingot metal, which channels are provided in the gap between the external shell and the lateral liquid surface of the solidifying ingot.

The provision of gating channels in the wall of the external shell permits a layer of molten metal to be formed around the lateral surface of the ingot liquid portion, the chemical composition of which differs from that of the ingot metal, whereby composite ingots or those clad with peripheral metal layer are possible to produce.

The cover is preferably formed with an observation opening intended for effecting visual control over the technological process, the state of the molten surface of the solidifying ingot, and over the supply of protective medium, such as slag or flux.

It is preferred to have the wall of the external shell formed with through openings intended for the protective medium to pass therethrough, which is supplied to the molten lateral surface of the solidifying ingot.

The through openings formed in the walls of the external shell are also intended for the supply of an agent used as the protective atmosphere beyond the wall of the external shell in the zone of electromagnetic field.

The flange of the interior shell is preferably formed with observation openings required for visual control over the state of the upper liquid portion of the solidifying ingot.

BRIEF DESCRIPTION OF THE DRAWINGS

The invention will be further described, by way of example only, with reference to the accompanying drawings, in which.

DETAILED DESCRIPTION OF THE PREFERRED EMBODIMENTS

Figure 1:
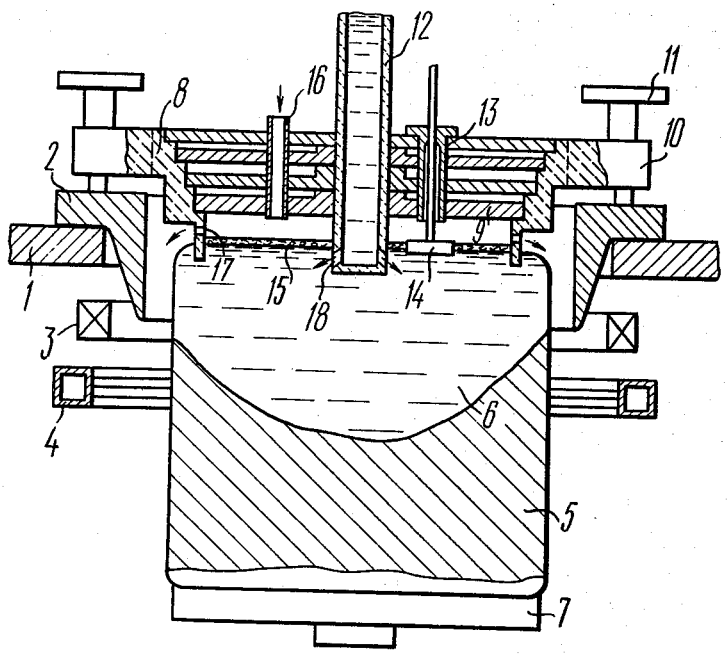
FIG. 1 is a longitudinal view, partly in section, of an apparatus for continuous casting of metal in electromagnetic field according to the invention.

The process according to the invention for continuous casting of metal in electromagnetic field is carried out as follows.

A molten metal to be cast into ingots is delivered onto a bottom plate disposed in electromagnetic field produced by a magnetic inductor annular in shape. Electromagnetic field is maintained so to enable the molten metal to be supported in the form of a column in a conventional manner.

According to one embodiment of the invention, the process is carried out with the use of a protective medium, preferably, a melt or vacuum (rarefied atmosphere). However, inert gases are likewise suitable for the purpose, which procedure is described in one of the known methods. A coolant is supplied to the bottom plate and onto the side surface of the solidified ingot, the cooling operation being also effected in a conventional manner.

The distinctive feature of the proposed process, however, lies in that protective medium is provided at least at the horizontal liquid portion of the ingot metal surface. The ingot casting process is effected in an electromagnetic field, wherein use is made of chemically active and easily oxidizable metals and alloys which do not form on their molten surfaces sufficiently dense and protective oxide film. Conducting slag and/or degassing flux are selected in accordance with the chemical composition of the ingot metal, providing either complete or partial protection to the ingot melt surface by means of a melt. Thereafter, it is possible to commence the ingot casting process, utilizing for this purpose high-temperature metals and alloys in need of heat protection to be afforded to the upper liquid portion of the ingot surface.

According to another embodiment of the invention, the upper liquid portion of the ingot is hermetically sealed and the ingot is cast under vacuum. When this happens, use is made of a funnel-shaped band with an annular section closely adjoining the ingot solidifying skin.

Such funnel-shaped band can be readily employed in other embodiments of the invention, wherein use is made of protective flux or slag. To this end, the gap between the liquid portion of the ingot surface and the interior surface of the funnel-shaped band is filled with conducting slag or degassing flux, thereby affording protection both to the upper and to the lateral molten surface of the ingot in the course of casting process effected in electromagnetic field. As a result, the quality of the ingot metal, as well as the lateral surface of the ingot, are improved.

Where it becomes necessary to produce an ingot having its lateral surface formed with the layer of metal having its chemical composition different from that of the ingot metal, as in the case of surface coating of the ingot base metal or in the case of composite ingots, the melt of this metal is poured into the gap between the ingot and the funnel-shaped band, as described in the preceding embodiment of the invention.

According to the preferred embodiment of the invention, a molten metal is delivered in an amount sufficient for building up constant metal static pressure with a value thereof being 5 to 20 percent in excess of the rated value of the electromagnetic field compression pressure, as the sizing of the ingot solidifying skin is concurrently effected by means of the funnel-shaped band. The size and shape of the opening area of the funnel-shaped band is selected in accordance with a specified size and shape of the ingot being cast.

By effecting the casting process of the invention in the above-described manner, the ingots are produced in strict conformity with a specified size and shape, for example, pentagonal, hexagonal or octagonal ingots having clearly defined sides and edges. It also becomes possible to utilize for the continuous casting process effected in electromagnetic field such metals as copper, magnesium, iron, zinc, silicon, titanium, etc.

The process of the invention has great practical significance, since the continuous casting of metal effected in electromagnetic field permits the production of high-quality ingots from refractory and easily oxidizable metals and alloys, as well as from alloys containing high vapour-pressure components, for example, such as zinc or cadmium in copper alloy; in other words, from metals and alloys which do not form on their surfaces a sufficiently protective oxide film necessary for stabilizing the process of contactless formation of ingots, the metal which, by nature of its physico-chemical characteristics require reliable protection from oxidation and heat losses, due to take place at the meniscus of its upper portion.

The continuous casting process of the invention is carried into effect by means of an apparatus having various constructional embodiments.

For example, where a protective medium, such as a melt or inert gas is provided only at the horizontal portion of the ingot melt surface, it is preferable to use the apparatus shown in FIG. 1.

The apparatus of FIG. 1 comprises, mounted on a frame in coaxial arrangement with one another, a ring-shaped baffle 2, a magnetic inductor 3 and a cooler 4. An ingot 5 with an upper liquid portion 6 is positioned on a bottom plate 7. According to the invention, the apparatus is provided with a shell 8 having its top part closed with a cover 9. The shell 8 is formed of a refractory nonmagnetic material chemically inert to a protective melt and having low heat conductivity, for example, such as graphite or ceramics. In the given embodiment of the invention, there is used only one shell 8 formed with an external flange 10 by means of which it is fixed on the baffle 2. To vary the depth of immersion of the shell 8 in the liquid portion 6 of the ingot 5, adjustment screws 11 are provided for the purpose. The cover 9 is formed with a central through opening to receive a header 12 through which a molten metal is delivered to be formed into an ingot. In addition, the cover 9 is formed with a through opening 13 through which extends a rod of a float gauge 14 for measuring the level of molten metal in the upper portion 6 of the ingot 5. A melt 15 of conducting slag of degassing flux can be delivered onto the surface of the liquid portion 6 of the ingot 5 through the header 12, and a shielding gas may be fed through a tube 16 and discharged through an opening 17 formed in the walls of the shell 8. The cover 9 can be formed of several plates arranged one above the other in the groove of the shell 8. Coaxial alignment of the respective openings in the plates and a size of the gap therebetween is ensured by an appropriate depth of the grooves and stop members provided in the body of the shell 8. The wall of the header 12 is formed with an opening 18 intended for the metal to be discharged therethrough in jets uniformly distributed in various directions underneath the surface layer of the molten metal.

The apparatus operates in the following manner. Prior to starting the ingot-forming process, the shell 8 is adjusted by means of the adjusting screws 11 at a level ensuring a prescribed depth of immersion of the lower end portion of the shell 8 in the liquid portion 6 of the ingot 5. Thence, the bottom plate 7 is introduced into the zone of the magnetic field so that the upper edges of its lateral surface extend 5 to 10 mm short of the transverse axis of the inductor 3. Thereafter, the inductor 3 is energized and a coolant is fed from the cooler 4 to the lateral surface of the bottom plate 7. The shell 8 is preheated to a temperature of 500° to 800° C. and a molten metal is delivered onto the bottom plate 7 through the header 12 to be formed into the ingot 5. When acted upon by the electromagnetic field of the inductor 3 the molten metal is formed into a column having the lower end face of the shell 8 immersed therein to a depth of 5 to 10 mm, a portion of molten conducting slag or degassing flux is fed through the header 12. The melt 15 is maintained on the surface of the liquid portion 6 of the ingot 5, thereby protecting the latter from oxidation and preventing excessive losses of heat from the meniscus of the liquid portion 6 of the ingot 5. If necessary, inert gases can be used as additional protection to the lateral surface of the ingot molten metal, fed in streams through the tube 16 underneath the cover 9 into the interior of the shell 8 and discharged through the openings 17 in the wall of the shell 8 and the upper liquid portion 6 of ingot 5 is washed by these streams.

The control over the level of the liquid portion 6 of the ingot 5 is effected either by means of the float level gauge 14 or visually by inspecting the open lateral surface of the liquid portion 6 of the ingot 5. In the course of casting, the shell 8 immersed in the melt 15 below the level of the ingot liquid surface over the perimeter of the liquid portion 6 of the ingot 5, serves to prevent oxide and slag solid nonmetallic inclusions from sliding off onto the lateral surface of the ingot liquid portion. As a result, the ingot forming and solidifying process, effected in the electromagnetic field, is stabilized.

Owing to the provision of a layer of protective degassing flux or conducting slag, serving as the heat protection for the meniscus of the ingot liquid portion, as well as due to the heat-shielding effect produced by the cover 9, with the oxides and slag inclusions being prevented by the shell 8 from getting onto the side surface of the ingot liquid portion, as protective atmosphere is concurrently created above the melt, spontaneous crystallization of metal on the meniscus of the ingot liquid portion is not permitted, and the split particles of the solidified metal and oxide or slag inclusions are prevented from getting to the lateral surface of the ingot liquid portion.

Thus, the resultant ingot, produced from metals such as, for example, copper, bronze, silicon brass, etc., that is from high-temperature and easily oxidizable metals and alloys, which, unlike aluminum and alloys thereof, do not form on their melt surfaces sufficiently protective oxide film, have sound crystalline structure and smooth side surface.

Figure 2:
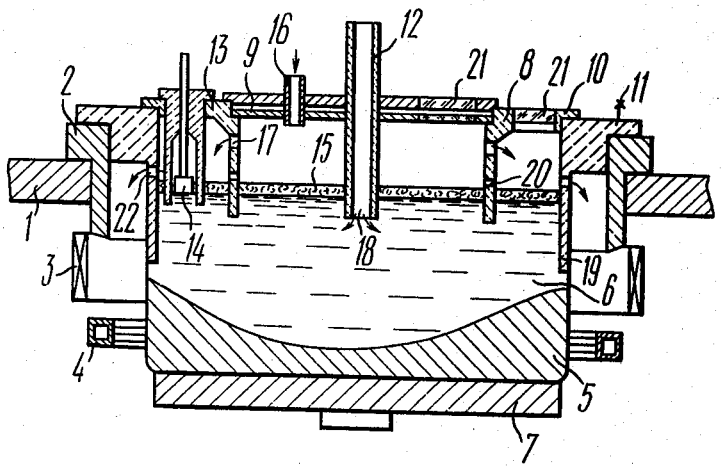
FIG. 2 is a longitudinal view of a continuous casting apparatus provided with two shells.

The apparatus according to another embodiment of the invention, shown in FIG. 2, comprises two shells.

This apparatus differs from the previously described one in that it has a second shell 19 arranged coaxially with and externally of the first shell 8. The shell 19 has its interior dimensions formed such as to enable its contact with the upper portion 6 of the lateral molten surface of the ingot 5. The shell 19, like the shell 8, is formed of a refractory nonmagnetic material chemically inert to the melt and having low heat conductivity. The shell 19 bears up against the baffle 2, and the shell 8 has its flange 10 thrust up against the shell 19. The float gauge 14 is preferably accommodated in the annular gap between the shells 8 and 19. The wall of the shell 8 is formed with ducts or passages 20 intended for the melt to flow therealong into the gap between the shell 8 and 19. Both, the cover 9 and the flange 10 of the interior shell 8 are preferably formed with observation openings 21 intended for visual control over the melt surface of the liquid portion 6 of the ingot 5. All the basic structural elements of the apparatus of this embodiment are similar to those of the previously described one, including the tube 16 for the supply of inert gas, the opening 17 formed in the wall of the shell 8, and the opening 22 formed in the external shell 19 and intended for the passage of inert gas therethrough. The process for the continuous casting of metal in electromagnetic field is effected essentially as described above in the first embodiment of the invention. Mounted on the magnetic baffle 2 is the external shell 19 whereupon is mounted the internal shell 8 with the cover 9, header 12 and float gauge 14, so as to prevent the lower end face of the external shell 19 from contacting the solidifying lateral surface of the ingot, while allowing the lower end face of the interior shell 8 to be immersed in the molten metal, to a depth of 5 to 15 mm. Prior to feeding the molten metal or a melt of flux or slag to the zone of electromagnetic field of the inductor 3, the shells 8 and 19, as well as the elements pertaining thereto, are heated to a temperature of 600° to 800° C.

The bottom plate 7 is also arranged in the zone of the electromagnetic field of the inductor 3. The inductor 3 is energized and the cooler 4 is operated to supply a coolant to the side surface of the bottom plate 7. Thereafter, the molten metal is delivered onto the bottom plate 7, whereupon the molten metal solidifies and forms an ingot. The moment for lowering the bottom plate 7 is determined by the level of the liquid portion 6 of the ingot 5, which level is controlled visiually through the observation openings 21 and/or by the readings of the metal level float gauge 14.

If necessary, the ingot casting process can be effected by feeding an inert gas serving as the protective atmosphere for the liquid portion 6 of the ingot 5, and fed to the ingot casting and forming zone through the tube 16, openings 17 in the wall of the interior shell 8, and through the openings 22 in the wall of the exterior shell 19. In the event of using conducting slag or degassing flux in the casting process, these are fed onto the surface of the molten metal through the header 12, whereupon the melt is spread over the surface of molten metal and overflows from the cavity of the interior shell 8 through the passages 20, formed in its walls, and into the gap between the shells 8 and 19.

The apparatus described in the second embodiment of the invention permits the ingot forming and solidifying process effected in electromagnetic field of the inductor 3 to be substantially stabilized, and the quality of ingots, especially of those produced from easily oxidizable metals and alloys, as well as from alloys comprising low-melting-temperature components, such as zinc in brass or cadmium in bronze, to be improved.

The apparatus of the invention is suitable for performing the casting process under a layer of degassing flux, which makes it possible to substantially reduce the loss of high vapour-pressure components, such as zinc, cadmium and phosphorus in copper alloys, escaping from the melt. The protection afforded by the shell wall to the side surface of the ingot liquid portion permits the rate of melt oxidation to be materially decreased and the loss of the low-melting-point alloy components escaping therefrom to be reduced.

Thus, as a result of the protection afforded by a layer of degassing flux to the entire upper portion of the ingot liquid zone, as well as the protection from oxidation afforded to the greater part of the side surface of the ingot liquid zone by the wall of the shell 19, it becomes possible:

to substantially reduce the loss of the low-melting-point alloy components escaping from the melt which, in turn, permits undesirable and uncontrolled turbulence of the ingot liquid portion to be eliminated to a great extent, whereby the quality of the ingot side surface and in the peripheral layer thereof is improved;

to substantially reduce the loss of heat by means of a melt and, consequently, to lower the casting temperature by 20° to 40° C., as compared to the prior-art continuous casting processes and apparatuses employed for similar purpose;

to substantially reduce the extent of oxidation of the ingot liquid portion, preventing the formation of oxides on the lateral surface of the ingot liquid zone, as well as their penetration to the ingot solidified lateral surface in the course of the ingot forming and solidifying process.

The protection of the upper portion of the ingot liquid zone effected by means of flux and of the ingot side surface by means of the wall of the external shell permits the ingot forming process and the solidification of the side surface of the ingot metal, be it from brasses or bronzes containing high vapour-pressure alloy components, to be considerably stabilized. With the apparatus of the invention it is feasible to produce ingots from brasses and bronzes, with high-quality side surfaces and sound crystalline structure.

Figure 3:
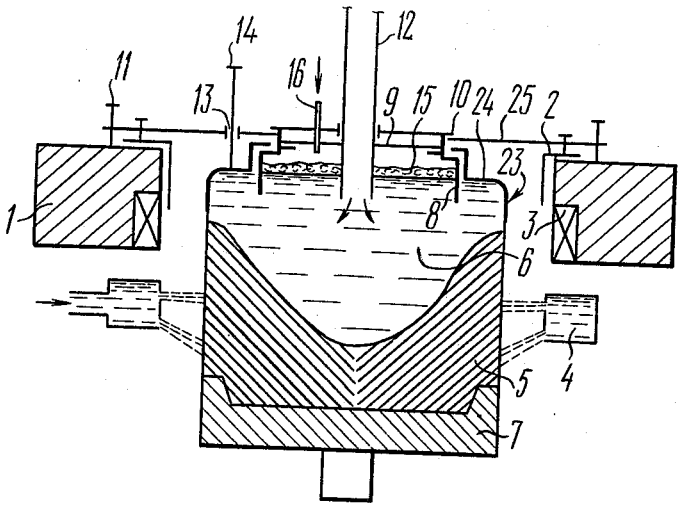
FIG. 3 is a schematic view of an apparatus provided with an external floating shell.

Shown in FIG. 3 is another embodiment of the invention, comprising a floating shell 23 formed of a material having its physical density 4 to 6 times lower than that of the melt of the ingot liquid portion. The shell 23 is provided with a flange formed internally thereof. Arranged adjacent the flange and fixed on the horizontal section 24 thereof is a rod of a means 14 for gauging the level of molten metal of the liquid portion 6 of the ingot 5. The shell 23 is positioned freely in the interspace between the interior shell 8 and the baffle 2. The shell 23 has its inner dimensions formed such as to enable its contact with the upper portion 6 of the lateral molten surface of the ingot 5, as well as the contact of the shell horizontal section 24 with the peripheral section 6 of the liquid horizontal surface of the ingot 5.

The internal shell 8 bears up against brackets 25 having mounted therein adjusting screws 11 intended for altering the depth of immersion of the shell 8 in the melt 15, irrespective of the displacements of the baffle 3, magnetic inductor 3 and annular cooler 4. The cover 9 closing the shell 8 is formed with an opening intended for the header 12 to extend therethrough, which header is used for the supply of molten metal, degassing flux or conducting slag to the zone of the ingot forming effected in electromagnetic field. The cover 9 also has a tube 16 intended for the passage of inert gas therethrough. The walls of the internal shell 8 is formed with openings 17 intended for the passage of gas to be used as the protective atmosphere set beyond the confines of the shell 8, the bracket 25 being provided with an opening to receive therein the rod of the metal level gauge 14.

The side surface of the internal shell 8 is formed with a projection, such as shown in FIG. 3, which is intended for fixing the internal shell 8 to the bracket 25, and for mounting the external floating shell 23 on the projection of the shell 8 during assembly and disassembly operations.

The cross-sectional dimensions of the vertical surfaces of the above-mentioned shells 8 and 23 are formed such as to enable their mutual displacement, as well as their contact with, and displacement of, relative to the side surface of the ingot liquid portion.

Other structural elements of this embodiment are similar to those described in the two previously mentioned embodiments of the present invention.

The apparatus of the invention, shown in FIG. 3, operates in the following manner.

Prior to starting the casting process, the bottom plate 7 is introduced into the zone of the electromagnetic field of the inductor 3, as described above in previous embodiments, whereupon a coolant is fed onto the lateral surface of the bottom plate 7. The inductor 3 is then energized and a required amount of coolant is delivered from the cooler 4. Thereafter, the preheated internal shell 8 with the cover 9, as well as the external shell 23 suspended during the assembly operation from the projection of the internal shell 8, are mounted on the bracket 25, so that the float gauge 14 is accommodated in the opening of the bracket 25. However, it is important for the lower portion of the external shell 23 to be clear of the solidified front on the ingot lateral surface. The molten metal is fed through the header 12 onto the bottom plate 7 and, with the internal shell 8 being immersed in the ingot melt surface, a melt of conducting slag or degassing flux is fed onto the ingot upper horizontal surface found within the confines of the internal shell 8. In addition, the internal shell 8 serves to prevent various oxide, slag and other solid nonmetallic inclusions from getting to the peripheral area of the ingot liquid portion, that is to the area of contact of the melt with the external shell, which, floating on the surface of the ingot liquid portion, protects the latter from oxidation and immediate contact with the ambient gas atmosphere, which, in turn, prevents the highly volatile components of the alloy from escaping therefrom.

The floating external shell 23 shows immediate and accurate response to an alteration in the level of the ingot liquid zone. Such alterations are easy to determine visually, as well as by means of any conventional control method, for example, by the radioisotope method wherein a signal is sent to an actuating mechanism operable to monitor the rate of metal consumption, or by the electrocontact method effected by means of sending a signal to a magnetic valve.

The floating external shell 23 closes the greatest part of the ingot liquid surface, thereby preventing the highly volatile components of the alloy from escaping therefrom and diminishing the detrimental effect of the convective flows, which, in turn, permits the alterations in the level of the ingot zone to be easily controlled within the range of ±2 mm.

Thus, the ingot produced from brass rich in zinc has been tested to show sound crystalline structure, with the surface thereof being free from flaws.

Figure 4:
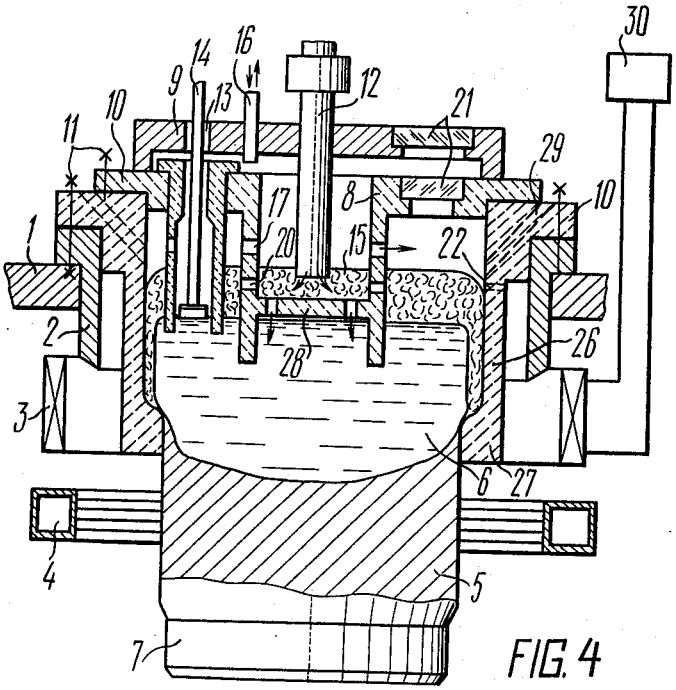
FIG. 4 is a view of an apparatus provided with an external shell formed with a sizing band.

Shown in FIG. 4 is the preferred embodiment of the invention. This embodiment of the apparatus makes it possible to use a protective melt or a rarefied atmosphere for effective protection of the entire surface of the ingot liquid portion. In addition, the ingot casting and sizing operations are combined in this apparatus.

Referring to its constructional aspect, the apparatus of this embodiment also comprises a frame 1 whereupon are mounted a baffle 2, inductor 3 and cooler 4. Mounted on the baffle 2 are two shells 8 and 26 with a cover 9. The distinctive constructional feature of this embodiment lies in the shell 26, the interior dimensions of which make for the gap to be formed at the upper section thereof between its interior surface and the ingot lateral liquid surface; a ring-shaped sizing band 27 being provided at the lower section of the ingot forming zone. The opening area of the sizing band 27 is shaped and sized in conformity with the cross-sectional shape and size of the finished ingot 5. Depending on the ingot metal, the interior cross-sectional dimensions of the upper portion of the external shell 26 are selected to be 0.85 to 1.15 times the respective dimensions of the sizing section or the band 27. The height of the sizing band 27 constitute $\frac{1}{2}$ to $\frac{2}{3}$ of the height of the inductor 3. The lower end face of the external shell 26 is disposed below the transverse axis of the inductor 3 within a distance of $\frac{1}{4}$ to $\frac{2}{3}$ of the height of the inductor 3.

The side walls of the internal shell 8 are perforated and are interconnected by means of a transverse perforated partition 28. The wall of the external shell 26 is preferably formed with gating channels 29 intended for the supply of metal therealong passing into the gap between the external shell 26 and the side molten surface of the liquid portion 6 of the ingot 5 and having chemical composition different from that of the ingot metal. The cover 9 and the flange 10 of the internal shell 8 are formed with observation openings 21 intended for visual control over the technological process. The shells 8 and 26 are provided with adjusting screws 11 enabling said shells to be mounted in a preset position. In the event of using a flowing protective gas atmosphere, the walls of the internal shell 8 are formed with openings 17 intended for the protective gas passed along the tube 16 to flow therethrough into the interior of the external shell 26. To maintain a required intensity of current and voltage on the inductor 3, the latter is provided with a regulator 30. The shell 26 has outlet openings 22 intended for the discharge of the inert gas therethrough.

The apparatus is operated in the following manner.

Prior to feeding molten metal, the bottom plate 7 is introduced into the zone of electromagnetic field of the inductor 3, so that the upper edge of the side surface thereof is positioned 3 to 10 mm below the level of the transverse axis of the inductor 3. The shell 26 is thence mounted on the baffle 2. The gap between the sizing band 27 of the shell 26 and the side surface of the bottom plate 7 is filled with a refractory mass. The inductor 3 is energized and a coolant is supplied at a required flow rate, whereupon the external shell 26 is heated to a temperature of 600° to 800° C. Thereafter, the shell 8 in assembly with all its elements, also preheated to a temperature of 600° to 800° C., is mounted on the shell 26. Thence, a requisite protective medium is provided, and a molten metal is fed to the ingot electromagnetic forming zone. After the molten metal portion 6 is raised to achieve a preset level, determined visually or by the readings of the metal level float gauge 14, an actuating mechanism is operated to lower the bottom plate 7 with the solidfying ingot. Then, if necessary, a layer of degassing flux and/or conducting slag is superimposed on the ingot molten surface.

In the event of using the process and apparatus of the invention for producing an ingot, the surface of which is coated with a thin layer of metal having its chemical composition different from that of the ingot metal, the melt of this metal is fed through the gating channels 29 to the ingot forming electromagnetic zone disposed in the gap between the ingot liquid portion and the wall of the external shell 26.

As has been mentioned above, it is of great practical significance to use the ingot contactless forming method effected in electromagnetic field and accompanied by immediate and intensive cooling of the ingot side surface, whereby high-quality ingots are produced to be in conformity with a prescribed profile and having uniform cross-section throughout its length, with the profile thereof being different from that of the ingot liquid portion.

This objective is successfully attained in the apparatus of the invention for continuous casting of metal in electromagnetic field, wherein the ingot-forming metal is delivered in an amount sufficient for creating constant metal static pressure with a value thereof being 5 to 20 percent above the rated value of the electromagnetic field compression pressure, and wherein the external shell 26, formed with the sizing band 27, is provided. Thus, as a result of the hot plastic deformation to which is subjected the skin of the solidifying ingot side surface, it becomes possible to produce ingots in strict conformity with a prescribed size and shape thereof. By firmly squeezing the ingot skin, a reliable tightening is provided, whereby the casting process is carried out so that the entire surface of the ingot liquid portion is protected with an inert gas, conducting slag and/or degassing flux; it also becomes possible to provide a rarefied atmosphere above the melt, and a layer of metal, having chemical composition different from that of the ingot metal, around the lateral surface of the ingot liquid portion.

It should be taken into account that the pressure force required to cause deformation of the ingot skin is insignificant, since the temperature of the ingot skin surface and that of the sizing band 27 are practically equal.

The sizing action effected by means of the shell continues until the ingot wall becomes strong enough to resist the pressure of the ingot liquid column. With the external shell 26 being movable along the technological axis of the apparatus, the position of the sizing band 27 of this shell can be changed relative to the solidifying portion of the ingot side surface, thereby permitting effective control to be carried out over the quality of the ingot surface and over the accuracy of its cross-sectional dimensions. After the ingot solidified portion has emerged from the cooling zone, the force of the metal static pressure is regulated by means of a metal consumption regulator or a molten flux consumption regulator until it reaches a required permissible value which can be determined by effecting visual control over the level of the ingot liquid portion or by means of the metal level float gauge 14. This regulation of the metal static pressure is undertaken with the purpose of providing for more effective reducing action of the sizing section 27 against the hot plastic skin of the ingot being cast. The sizing section 27 of the external shell 26, the upper portion of which remains clear of the ingot liquid portion, acts upon the ingot skin radially towards the ingot longitudinal axis above the level from which a coolant is supplied to the surface of the solidified ingot at the liquid-solid interface of its metal. The ingot forming process effected under conditions of constant metal static pressure being 5 to 20 percent in excess of the rated value of the electromagnetic field compression pressure, is ensured by way of maintaining the level of the ingot liquid portion above the rated level through the regulator intended for monitoring the flow rate of molten metal or that of molten conducting slag and/or degassing slag.

The rated value of the metal static pressure of the melt is equal to the value of the electromagnetic field pressure acting to support the column of molten metal in prescribed cross-sectional dimensions over its height.

The production of sized ingots, with the cross-sectional profile thereof being different from that of the ingot liquid portion, is made possible due to the provision of an appropriately shaped and sized opening area of the sizing section 27 of the external shell 26, the profile and dimensions of which are formed with due regard to the extent of metal shrinkage, taking place during the ingot solidification and cooling processes.

Where it is required to carry out the continuous casting process in a flowing protective gas atmosphere, the walls of the external shell 26 are formed with through openings 22.

It is possible for a rarefied atmosphere to be created above the surface of the liquid portion 6 of the ingot 5. This being the case, the internal shell 8 is positioned in a manner to have its perforated partition 28 arranged below the level of the ingot molten metal, the through openings 22 in the external shell 26 being hermetically sealed.

The process according to the invention for continuous casting of metal in electromagnetic field is carried out so that a coolant is at all times fed onto the solidified ingot, preferably, after sizing operation.

The process and apparatus of the invention permitting the production of high-quality ingots from copper and alloys thereof, that is from all the metals and alloys suitable for the production of ingots having great practical application.

What is claimed is:

1. A process for continuous casting of metal in electromagnetic field, which comprises delivering a molten metal onto a bottom plate disposed in said electromagnetic field acting to support said molten metal in the form of a column which solidifies from the bottom to the top with a liquid portion at the top of said column and a solidifying skin being formed about said column; feeding a coolant to the side surface of solidified ingot; and providing a protective medium about the liquid portion of said column, said protective medium being held in place at ingot side surface of said liquid portion by means of a funnel-shaped band formed with an annular section with its bottom portion closely adjoining the ingot solidifying skin above the level from which the coolant is fed to the ingot side surface.

2. A process for continuous casting of metal in electromagnetic field as claimed in claim 1, wherein conducting slag is used as the protective medium.

3. A process for continuous casting of metal in electromagnetic field as claimed in claim 1, wherein degassing flux is used as the protective medium.

4. A process for continuous casting of metal in electromagnetic field as claimed in claim 1, wherein a rarified atmosphere is used as the protective medium.

5. A process for continuous casting of metal in electromagnetic field as claimed in claim 1, wherein a metal having chemical composition different from that of the ingot metal is used as the protective medium.

6. A process for continuous casting of metal in electromagnetic field as claimed in claim 1, wherein the ingot-forming metal is delivered in an amount sufficient for building up constant metal static pressure with a value thereof being 5 to 20 percent in excess of the rated value of the electromagnetic field compression pressure, as the skin of the solidifying ingot is concurrently sized by means of the annular section of the funnel-shaped band with the cross-sectional size and shape thereof being selected in conformity with the cross-section size and shape of the finished ingot.

7. An apparatus for carrying into effect the continuous casting of metal in electromagnetic field, comprising: a frame; a ring-shaped baffle for shielding the electromagnetic field mounted onsaid frame; a magnetic inductor mounted on said frame and arranged coaxially with said baffle; a ring shaped cooler mounted on said frame and arranged coaxially with said ring-shaped baffle and said magnetic inductor; said ring-shaped baffle, magnetic inductor and cooler forming and enveloping an ingot-forming space; a bottom plate located in and forming the bottom of said ingot-forming space; a cover positioned above said ring-shaped baffle and forming the top of said ingot-forming space, said cover having a first opening for the ingot-forming metal in molten form to pass therethrough, a second opening for a rod of a metal level float gauge to extend therethrough and indicate the height of the molten ingot-forming metal in said ingot-forming space, and a third opening for a protective medium which prevents oxidation of the molten-ingot forming metal to pass therethrough; at least one shell positioned on said cover in the ingot-forming space and, fixed on said baffle means by a flange in a manner to permit the lower end face of said shell to be immersed in the ingot molten metal to define a portion of the horizontal liquid portion of the ingot surface as being confined within said shell lower end face so that the latter constitutes a boundary around said ingot liquid surface portion, said shell being formed of a refractory nonmagnetic material chemically inert to the protective medium and having low conductivity and means for introducing the protective medium through said third opening onto the ingot liquid surface portion bounded by said shell end face.

8. An apparatus as claimed in claim 7, wherein there is provided a second shell spaced externally of and coaxially with the first said shell and fixed on the said baffle, the interior dimensions of the second shell being formed such as to enable its contact with the upper portion of the liquid side surface of the ingot being cast.

9. An apparatus as claimed in claim 7, and being further provided with an external shell which is formed of a material with a physical density thereof being 4 to 6 times lower than that of the molten metal portion, and having a horizontal section with a rod of metal level gauging means fixed thereto, said external shell being freely mounted in the interspace between said internal shell and baffle and having its interior dimensions formed such as to enable its contact with the upper portion of the ingot liquid side surface, as well as the contact of the shell horizontal section with the peripheral section of the horizontal liquid surface of the ingot being cast.

10. An apparatus as claimed in claim 8, wherein said second shell has interior dimensions formed such as to provide a gap at the upper portion thereof between its interior surface and a predetermined imaginary cylindrical surface adapted to coincide with the liquid portion of the ingot side surface, said second shell being formed at the lower portion thereof in the ingot-forming zone with a ring-shaped sizing band having its opening area sized and shaped so as to conform to a specified desired size and shape of the finished ingot.

11. An apparatus as claimed in claim 10, wherein the interior cross-section dimensions of the upper portion of the said external shell are 0.85 to 1.15 times the respective dimensions of the sizing band the height of which is $\frac{1}{2}$ to $\frac{2}{3}$ of the height of said inductor, the lower end face of said shell being positioned below the transverse axis of the inductor within a distance of $\frac{1}{4}$ to $\frac{2}{3}$ of the inductor height.

12. An apparatus as claimed in claim 10, wherein the side walls of the said internal shell are perforated and interconnected by means of a transverse perforated partition.

13. An apparatus as claimed in claim 10, wherein the wall of the said external shell is formed with gating channels intended for the supply of metal therealong having its chemical composition different from that of the ingot metal, in the interspace between the external shell and the side liquid surface of the ingot being cast.

14. An apparatus as claimed in claim 8, wherein the said cover is formed with an observation opening.

15. An apparatus as claimed in claim 8, wherein the wall of the said external shell is formed with through openings for the protective medium fed to the liquid side surface of the ingot being cast to pass therethrough.

16. An apparatus as claimed in claim 8, wherein the flange of the said internal shell is formed with observation openings.

* * * * *